US006186905B1

(12) United States Patent
Kosmatka

(10) Patent No.: US 6,186,905 B1
(45) **Date of Patent: *Feb. 13, 2001**

(54) METHODS FOR DESIGNING GOLF CLUB HEADS

(75) Inventor: John B. Kosmatka, Carlsbad, CA (US)

(73) Assignee: Callaway Golf Company, Carlsbad, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/787,202

(22) Filed: Jan. 22, 1997

(51) Int. Cl.[7] ..... A63B 53/04
(52) U.S. Cl. ..... 473/291; 473/314; 473/349
(58) Field of Search ..... 473/291, 349, 473/314

(56) References Cited

U.S. PATENT DOCUMENTS

| | | | | |
|---|---|---|---|---|
| 2,231,847 | | 2/1941 | Dickson et al. . | |
| 3,703,824 | | 11/1972 | Osborne et al. . | |
| 3,941,390 | * | 3/1976 | Hussey | 473/292 |
| 4,420,156 | * | 12/1983 | Campau | 473/291 |
| 4,802,672 | * | 2/1989 | Long | 473/291 |
| 4,840,380 | * | 6/1989 | Kajita | 473/291 |
| 4,887,815 | * | 12/1989 | Hughes | 473/291 |
| 5,018,382 | | 5/1991 | Kelley et al. . | |
| 5,046,733 | * | 9/1991 | Antonious | 473/287 |
| 5,131,986 | | 7/1992 | Harada et al. . | |
| 5,224,705 | * | 7/1993 | Scheie | 473/291 |
| 5,275,412 | * | 1/1994 | Innes | 473/338 |
| 5,309,753 | | 5/1994 | Johnson . | |
| 5,318,296 | | 6/1994 | Adams et al. . | |
| 5,335,914 | * | 8/1994 | Long | 473/350 |
| 5,351,953 | | 10/1994 | Mase . | |
| 5,366,223 | * | 11/1994 | Werner | 473/349 |
| 5,447,309 | * | 9/1995 | Vincent | 473/335 |
| 5,528,927 | | 6/1996 | Butler et al. . | |
| 5,616,086 | * | 4/1997 | Chappell | 473/291 |
| 5,628,698 | * | 5/1997 | Sumitomo | 473/349 |
| 5,669,824 | * | 9/1997 | Aizawa | 473/350 |
| 5,836,830 | * | 11/1998 | Onuki | 473/349 |

FOREIGN PATENT DOCUMENTS

| | | | |
|---|---|---|---|
| 0 377 673 B1 | | 2/1989 | (EP) . |
| 5-57034 | * | 3/1993 | (JP) . |

OTHER PUBLICATIONS

Determining the central principal inertia dyadic of a golf club head, Twigg, M.J. and Butler, J.H., Experimental Techniques, Sep./Oct.1996.
Shames, Irvine H., Engineering Mechanics, 4th ed., 1996.
Griffiths, J. B., The Theory of Classical Dynamics, 1985.
Greenwood, Donald T., Principles of Dynamics, 1965.
Meirovitch, Leonard, Methods of Analytical Dynamics, 1970.
Meriam, J.L. & Kraige, L.G., Dynamics, 4th ed., Engineering Mechanics, vol. 2.
Hibbeler, R.C., Engineering Mechanics, Dynamics, 8th ed., 1997.
Kane, Thomas R. and Levinson, David A., Dynamics, Theory and Applications, 1985.
McGill, David J. and King, Wilton W., Engineering Mechanics, Statics, 3rd ed., 1995.

* cited by examiner

*Primary Examiner*—Jeanette Chapman
*Assistant Examiner*—Stephen L. Blau
(74) *Attorney, Agent, or Firm*—Lyon & Lyon; Thomas R. Weber; Michael A. Catania

(57) ABSTRACT

Methods for designing golf club heads and inertially tailored golf club heads designed in accordance with such methods. A location for a center of gravity (CG) of a golf club head and magnitudes and directions of the principal moments of inertia of the golf club head are selected, and mass is distributed within the golf club head such that the center of gravity of the golf club head is located at the selected center of gravity location, and such that the principal moments of inertia of the golf club head have the selected magnitudes and directions.

19 Claims, 8 Drawing Sheets

METHODS FOR DESIGNING GOLF CLUB HEADS

BACKGROUND OF THE INVENTION

The field of the present invention is golf club heads and, more particularly, inertially tailored golf club heads and methods of designing the same.

In recent years, substantial attention has been directed to the development of two types of golf club heads, cavity backed heads for iron or wedge type golf clubs (shown in FIGS. 1(*a*)–1(*c*)), and oversized heads for metal wood type golf clubs (shown in FIGS. 2(*a*)–2(*c*)). When these golf club heads are designed utilizing conventional design methodologies, substantial efforts have been undertaken to locate the center of gravity (CG) of the golf club head in a predetermined or preferred position relative to the face.

Prior to this time, however, conventional design methodologies have failed to take into consideration the complete inertia tensor or moments and products of inertia of a golf club head. As a result, golf club heads developed in accordance with conventional design criteria and/or conventional design methodologies often do not perform optimally and display large coupled dynamic responses as they travel through a typical swing motion.

Accordingly, it is believed that those skilled in the art would find a method of designing golf club heads that addresses and takes into consideration the entire inertia tensor of a golf club head to enhance the performance of the golf club head to be quite useful. It is also believed that those skilled in the art would find inertially tailored golf club heads developed in accordance with such methods to be quite useful.

SUMMARY OF THE INVENTION

In one innovative aspect, the present invention is directed toward a method of designing a golf club head that takes into consideration the entire inertia tensor of the golf club head, thus allowing coupled dynamic responses during a swing motion to be minimized.

In one preferred form, the inertia tensor of a golf club head is defined using the magnitude and direction of the principal moments of inertia (i.e., the magnitude and direction of the maximum moment of inertia, the minimum moment of inertia, and an intermediate moment of inertia) of the golf club head. Thus, in accordance with the present invention, a preferred location of a center of gravity (CG) of a golf club head may be selected, magnitudes and directions of the principal moments of inertia of the golf club head may be selected, and mass may be distributed within the golf club head such that the center of gravity of the golf club head is located at the selected location, and such that the principal moments of inertia of the golf club head have the selected magnitudes and directions.

Those skilled in the field of dynamics will appreciate that the axes of the principal moments of inertia define a unique coordinate frame, wherein the inertia properties of the golf club head are completely uncoupled (i.e., wherein all products of inertia are 0), and wherein the moment of inertia about a first principal axis corresponds to the absolute maximum body inertia, the moment of inertia about a second principal axis corresponds to the absolute minimum body inertia, and the moment of inertia about a third axis is an intermediate value. Thus, by defining the magnitudes and directions of the principal moments of inertia of a golf club head, one inherently defines a complete inertia tensor of the golf club head. It further follows that a golf club head designed in the manner described above will exhibit those dynamic properties that are defined by the complete inertia tensor of the club head.

In another innovative aspect, the present invention is directed toward methods of improving golf club head performance by tailoring the mass distribution of a golf club head in a fashion that will minimize coupled dynamic club head motion as the golf club head progresses, for example, through the motion of a swing. To achieve this objective, it is presently preferred to have the axes of the principal moments of inertia of a golf club head point in directions that closely align with the directions of the primary forces that act upon the golf club head during a typical swing. These forces include the force that is exerted upon the golf club head as a ball impacts the face of the club head, and the aerodynamic drag, inertia and centrifugal forces that are exerted upon the golf club head as the club head travels through a typical swing. It will be understood that the inertia force is a swing-produced dynamic force that is tangent to the swing path of the center of gravity of a golf club head. Thus, in a golf club head designed in accordance with a preferred form of the present invention, one of the principal axes of inertia may point in a ball impact direction or in the direction of the inertia force at the moment of ball impact (i.e., may be located in a horizontal plane and be perpendicular to a line defined by the intersection of a plane of the face and the horizontal plane), and another principal axis of inertia may be perpendicular to the first and point in the direction of the centrifugal force that is produced during the swing motion. As the direction of the centrifugal force that results during the swing motion will vary depending upon shaft flex and dynamic toe-down effects, it is presently preferred that the principal axis of inertia associated with that force be oriented in a direction ranging from vertical to a direction coincident with the lie angle of the golf club head. The final principal axis of inertia is preferably perpendicular to the other two principal axes of inertia and generally may be oriented within the plane of the face of the golf club head and in a near horizontal direction.

In still another innovative aspect, the present invention is directed toward a method of directly controlling the dynamic behavior of a golf club head by adjusting the magnitudes and directions of the principal moments of inertia of the golf club head. For example, the effective sweet spot region of a golf club head may be increased by increasing the moment of inertia about a principal axis that passes through the center of gravity of the golf club head and is oriented, for example, in a vertical direction; the resistance to changes in the dynamic loft of the golf club head upon ball impact may be increased by increasing the moment of inertia about a principal axis oriented, for example, along a line defined by an intersection of a horizontal plane and a face plane of the golf club head; and an overall club toe-down effect may be altered by changing the moment of inertia about a principal axis oriented, for example, in a horizontal plane and pointing in a direction of ball impact. Finally, decreasing the inertia about the hosel (or shaft) axis of a golf club head will decrease the required player-supplied wrist torque needed to bring the club face to square at the moment of ball impact.

In still another innovative aspect, the present invention is directed toward improved golf club heads that are designed in accordance with the above-described methods. For example, in one preferred embodiment, a golf club head for an iron golf club may have a principal axis of inertia that is oriented such that an inertia loft angle ($\theta_{inertia}$) of the golf club head is less than the geometric loft angle ($\theta_{GL}$) of the golf club head. Indeed, in the preferred embodiment shown in FIG. 5(*a*), one of the principal axes of inertia ($PA_1$) of the golf club head is oriented in the vertical direction, thus reducing the inertia loft angle ($\theta_{inertia}$) of the golf club head to 0.° In other preferred embodiments, a golf club head may have at least one principal axis of inertia that is aligned with a direction of a force that acts upon the golf club head when the golf club head impacts a golf ball. The golf club head may also have a principal axis of inertia that is aligned with a direction of a centrifugal force that acts upon the golf club head as the golf club head travels through a swing motion.

In still further embodiments, a golf club head in accordance with the present invention may have a principal axis of inertia that forms an acute angle with a plane of the face of the golf club head in the direction of the face/sole interface of the golf club head.

Accordingly, it is an object of the present invention to provide improved methods for designing golf club heads.

It is another object of the present invention to provide a new design procedure that improves golf club head performance by tailoring the mass distribution of a golf club head to specifically locate the center of gravity (CG) of the golf club head and make use of all of the coefficients of the inertia tensor of the golf club head.

It is still another object of the present invention to provide a new design procedure that improves golf club head performance by tailoring the mass distribution of a golf club head to specifically locate the center of gravity (CG) within the golf club head and make use of the directions of the principal inertia axes and the corresponding maximum, minimum and intermediate principal moments of inertia of the golf club head.

It is still another object of the present invention to provide improved golf club heads wherein the principal inertia axes are more closely aligned with the directions of the primary forces (i.e., impact and centrifugal) that act upon the golf club head during a typical swing motion.

It is still another object of the present invention to use one or more dissimilar materials during the construction of a golf club head to produce improved club head performance characteristics by controlling the location of the center of gravity of the club head and defining preferred magnitudes and directions of the principal moments of inertia of the club head.

BRIEF DESCRIPTION OF THE DRAWINGS

FIG. 1(*b*) is a front view looking at the face of the conventional iron or wedge type golf club head shown in FIG. 1(*a*).

FIG. 1(*c*) is a top view of the conventional iron or wedge type golf club head shown in FIGS. 1(*a*) and 1(*b*).

FIG. 2(*b*) is a front view looking at the face of the conventional metal wood golf club head shown in FIG. 2(*a*).

FIG. 2(*c*) is a top view of the conventional metal wood golf club head shown in FIGS. 2(*a*) and 2(*b*).

FIG. 3(*b*) is a front view of the conventional wedge or iron type golf club head shown in FIG. 3(*a*).

FIG. 3(*c*) is a top view of the conventional wedge or iron type golf club head shown in FIGS. 3(*a*) and 3(*b*).

FIG. 4(*b*) is a front view of the conventional metal wood golf club head shown in FIG. 4(*a*).

FIG. 4(*c*) is a top view of the conventional metal wood golf club head shown in FIGS. 4(*a*) and 4(*b*).

FIG. 5(*b*) is a front view of the wedge or iron type golf club head shown in FIG. 5(*a*).

FIG. 5(*c*) is a top view of the wedge or iron type golf club head shown in FIGS. 5(*a*) and 5(*b*).

FIG. 6(*b*) is a front view of the metal wood golf club head shown in FIG. 6(*a*).

FIG. 6(*c*) is a top view of the metal wood golf club head shown in FIGS. 6(*a*) and 6(*b*).

FIG. 7(*b*) is a front view of the wedge or iron type golf club head shown in FIG. 7(*a*).

FIG. 7(*c*) is a top view of the wedge or iron type golf club head shown in FIGS. 7(*a*) and 7(*b*).

FIG. 8(*b*) is a front view of the metal wood golf club head shown in FIG. 8(*a*).

FIG. 8(*c*) is a top view of the metal wood golf club head shown in FIGS. 8(*a*) and 8(*b*).

DESCRIPTION OF PREFERRED EMBODIMENTS

Figure 1A:
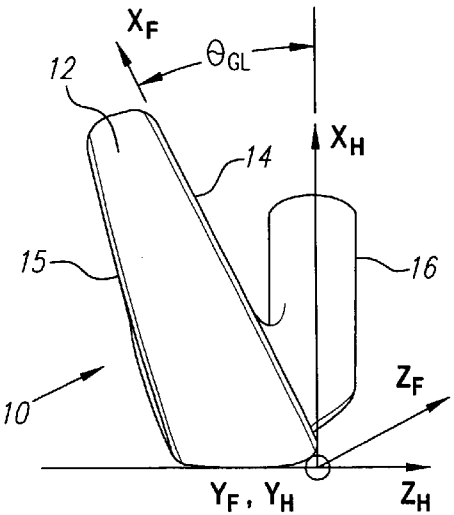
FIG. 1A (PRIOR ART)
FIG. 1(*a*) is a toe-side view looking at the toe of a conventional iron or wedge type golf club head.
Figure 1B:
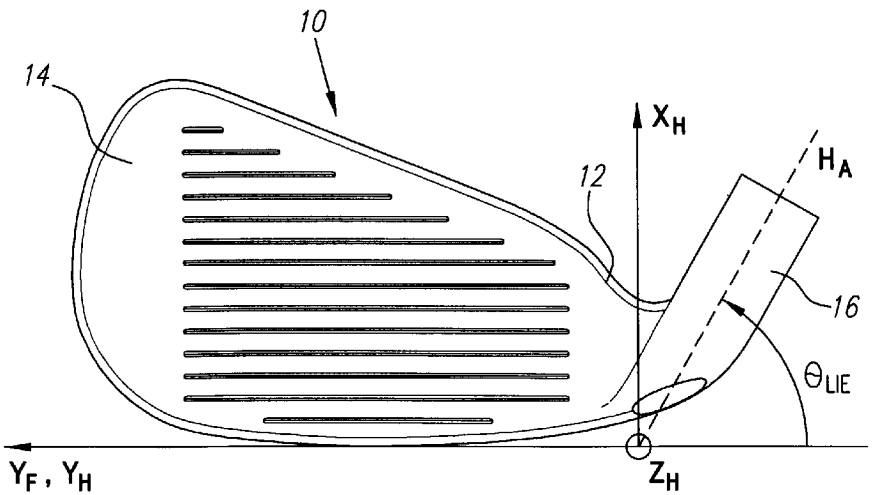
FIG. 1B (PRIOR ART)
Figure 1C:
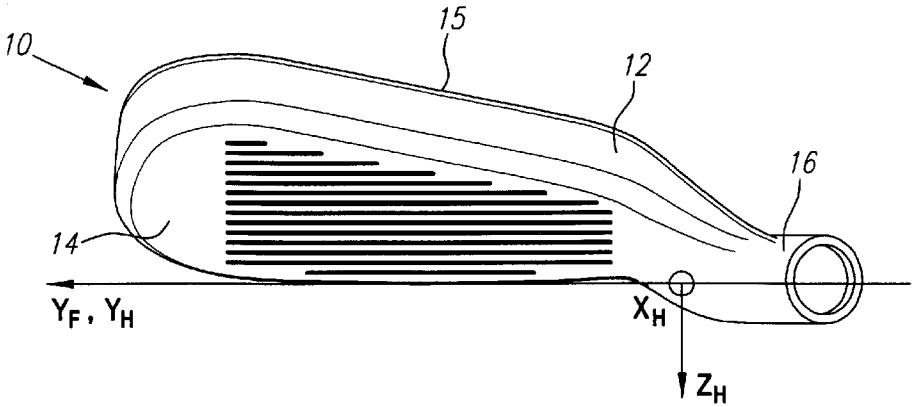
FIG. 1C (PRIOR ART)

Turning now to the drawings, FIGS. 1(*a*)–1(*c*) and 2(*a*)–2(*c*) provide an illustration of a typical golf club head 10 for an iron or wedge type golf club, and an illustration of a typical golf club head 20 for a metal wood type golf club. It will be understood that all illustrations and frames of reference used herein apply to a golf club head at proper ball address position.

As shown in FIGS. 1(*a*)–1(*c*), the iron or wedge type golf club head 10 has a body 12, face 14 and hosel 16. The hosel 16 has a central axis $H_A$, and the face 14 of the club head 10 lies in a plane ($X_F$–$Y_F$). The golf club head 10 also has a geometric loft angle $\theta_{GL}$ defined as the angle from vertical ($X_H$) to the face plane ($X_F$–$Y_F$), and a geometric lie angle $\theta_{lie}$ defined as the angle from horizontal ($Y_H$) to the hosel central axis $H_A$.

Figure 2C:
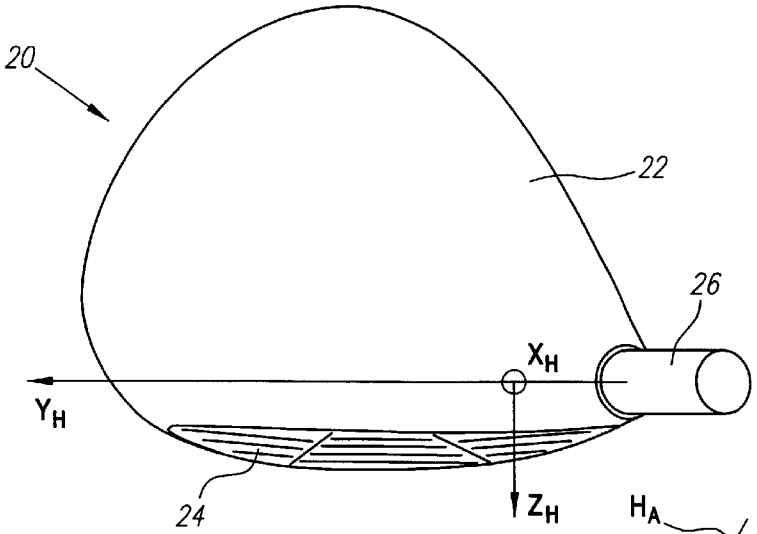
FIG. 2C (PRIOR ART)
FIG. 2(*a*) is a toe-side view of a conventional metal wood golf club head.
Figure 2B:
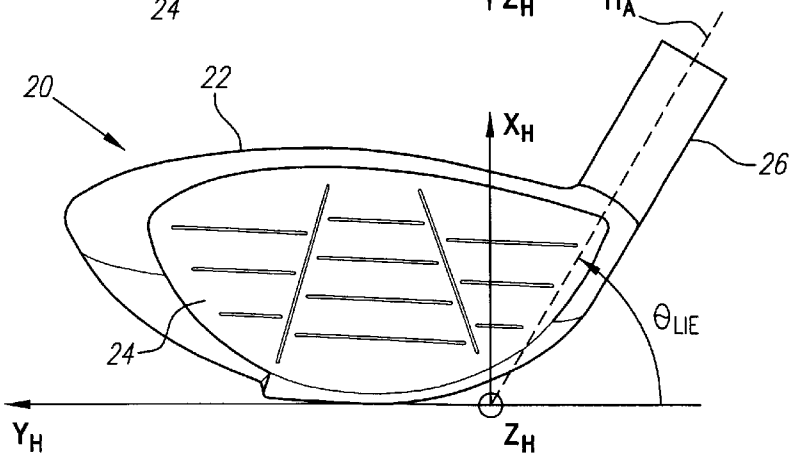
FIG. 2B (PRIOR ART)
Figure 2A:
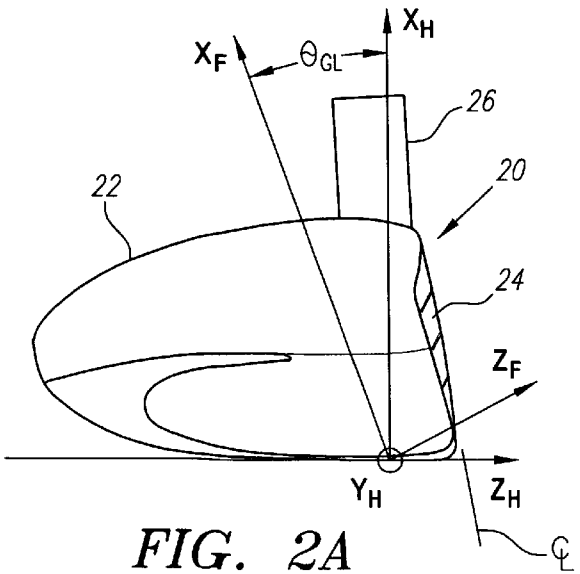
FIG. 2A (PRIOR ART)

As shown in FIGS. 2(*a*)–2(*c*), the metal wood club head 20 has a body 22, face 24 and hosel 26. The hosel 26 has a central axis $H_A$, and the face 24 of the metal wood club head 20 has a center line $C_L$ located in a vertical plane ($X_H$–$Z_H$). The metal wood club head 20 also has a geometric loft angle $\theta_{GL}$, which is defined as the angle from vertical ($X_H$) to a line $X_F$ parallel to the center line $C_L$, and a geometric lie angle $\theta_{lie}$, which is defined as the angle from horizontal ($Y_H$) to the hosel central axis $H_A$.

As has been explained in the introductory sections above, prior to this time, conventional golf club head design methodologies have failed to take into consideration the complete inertia tensor or, stated differently, all of the moments and products of inertia of a golf club head. As a result, golf club heads developed in accordance with conventional design methodologies have often performed less than optimally and displayed large coupled dynamic responses as they travel through a typical swing motion. In contrast, design methodologies in accordance with the present invention take into consideration the complete inertia tensor of a golf club head in an effort to minimize any coupled dynamic responses that may occur as the golf club head travels through a typical swing motion.

For example, in one preferred method, the inertia tensor of a golf club head is defined using the magnitude and direction of the principal moments of inertia (i.e., the magnitude and direction of the maximum moment of inertia, the minimum moment of inertia, and an intermediate moment of inertia) of the golf club head. Thus, in accordance with the present invention, a preferred location of a center of gravity (CG) of a golf club head may be selected, preferred magnitudes and directions of the principal moments of inertia of the golf club head may be selected, and mass may be distributed within the golf club head such that the center of gravity of the golf club head is located at the preferred location, and such that the principal moments of inertia of the golf club head have the preferred magnitudes and directions. It will be understood that in accordance with the present invention the center of gravity of the golf club head may be located either at a preferred point within the golf club head or within a preferred region of the golf club head.

Those skilled in the field of dynamics will appreciate that the axes of the principal moments of inertia define a unique coordinate frame, wherein the inertia properties of the golf club head are completely uncoupled (i.e., wherein all products of inertia are 0), and wherein the moment of inertia about a first principal axis corresponds to the absolute maximum body inertia, the moment of inertia about a second principal axis corresponds to the absolute minimum body inertia, and the moment of inertia about a third axis is an intermediate value. Thus, by defining the magnitudes and directions of the principal moments of inertia of a golf club head, one inherently defines a complete inertia tensor of the golf club head. It further follows that a golf club head designed in the manner described above will exhibit those dynamic properties that are defined by the complete inertia tensor of the golf club head.

Those skilled in the art of dynamics will also understand that to maximize the inertia of a golf club head in a particular direction, it is necessary to have one of the principal axes of inertia pointing in that same direction. Moreover, as a result of the inertia uncoupling (0 products of inertia) associated with the principal axes, one finds that: (1) the angular momentum vector and the rotational velocity vectors described in the preferred axes system are parallel; and (2) applied generalized forces (i.e., torques) acting in the principal frame will produce uncoupled rotational accelerations and velocities also in the principal frame. Thus, dynamic forces, aerodynamic forces and ball impact forces acting on the golf club head as a result of the club swing will produce uncoupled club head motion if the loads act parallel to the principal axes. Accordingly, in one preferred form of the present invention, a golf club head may be designed such that the principal axes of inertia of the golf club head point in directions that closely align with the directions of the primary forces that are applied to the club head during a typical swing. These primary forces include the ball impact force, aerodynamic drag force and swing-produced centrifugal and inertia forces described above.

Figure 3C:
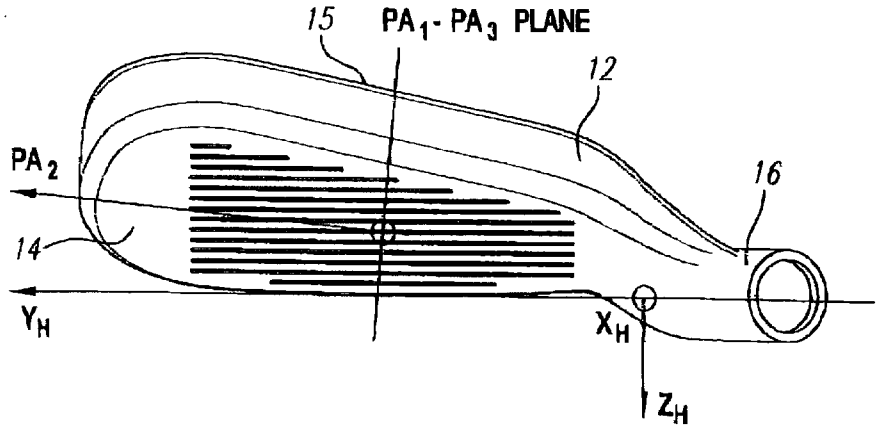
FIG. 3C (PRIOR ART)
FIG. 3(*a*) is a toe-side view of a conventional wedge or iron type golf club head showing a nominal center of gravity (CG) location and the principal inertia axes of the golf club head.
Figure 3B:
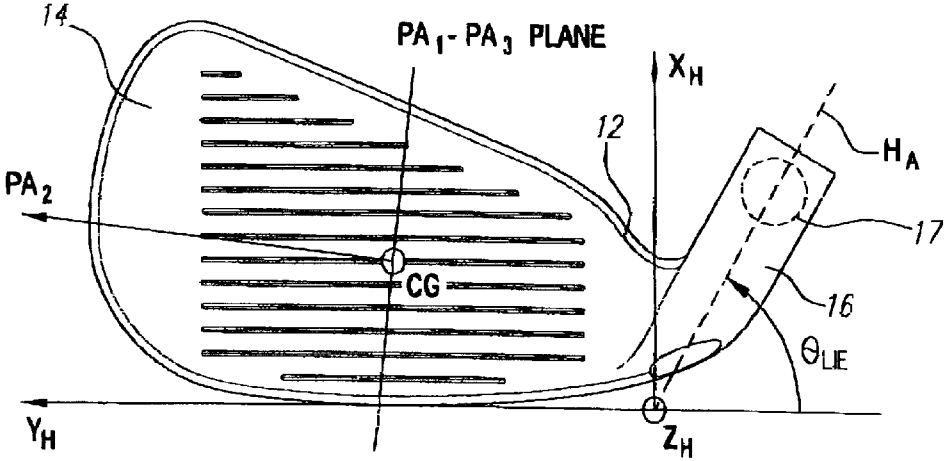
FIG. 3B (PRIOR ART)
Figure 3A:
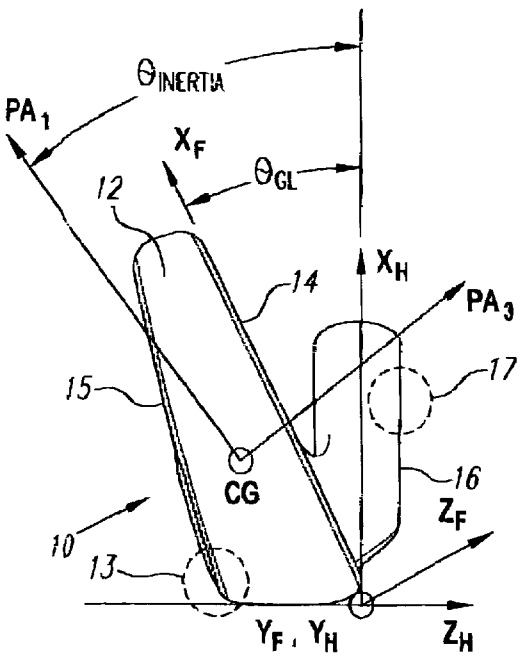
FIG. 3A (PRIOR ART)

Now, turning to FIGS. 3(*a*)–3(*c*) and 4(*a*)–4(*c*), it has been experimentally determined through the testing of commercially available golf clubs that the principal axes of inertia $PA_1$, $PA_2$, and $PA_3$ of conventional golf club heads do not point in directions that closely align with the directions of the primary forces that are applied to the club heads during a typical swing motion. Nor do the principal axes of inertia $PA_1$, $PA_2$, and $PA_3$ of conventional golf club heads 10 and 20 align with the global axes ($X_H$, $Y_H$, $Z_H$) of the club heads 10 and 20.

For example, as illustrated in FIGS. 3(*a*)–3(*c*), it has been experimentally observed in test cases of commercially available wedge and iron club heads 10 that two of the principal axes of inertia $PA_1$ and $PA_2$, which correspond to the intermediate and minimum inertia directions, respectively, lie in an inertia plane ($PA_1$–$PA_2$) that is tilted rearwardly in relation to the club face plane ($X_F$–$Y_F$) of the golf club head 10, where one of the principal axes $PA_1$ (corresponding to the intermediate inertia direction) lies in a plane ($PA_1$–$PA_3$) and is tilted rearwardly in relation to a vertical direction $X_H$, and the other principal axis $PA_2$ (corresponding to the minimum inertia direction) is tilted similarly from horizontal. The third principal axis $PA_3$ (corresponding to the maximum inertia direction) is perpendicular to the first two principal axes $PA_1$ and $PA_2$ and is tilted upward in relation to the face plane ($X_F$–$Y_F$). Further, for those golf club heads 10 tested to date, the inertia loft angle $\theta_{inertia}$, defined as angle from vertical to a plane defined by the first and second principal axes $PA_1$ and $PA_2$, was always greater than the geometric loft $\theta_{GL}$ of the club face 14. This occurs because in those golf club heads that have been tested to date mass is not concentrated to a sufficient degree in the lower rearward section 13 of the body 12 the golf club heads 10 or in the upper front section 17 of the hosel 16 of the golf club heads 10. Thus, the orientations of the principal axes of inertia $PA_1$, $PA_2$, and $PA_3$ of the conventional iron or wedge type golf club heads 10 that have been tested to date are (1) defined predominantly by the geometric loft angle $\theta_{GL}$ of the club heads 10 and (2) significantly rotated from the preferred club head vertical ($X_H$) and horizontal ($Z_H$) axes. This results in less than maximum or optimal moment of inertia properties in the club head frame ($X_H$, $Y_H$, $Z_H$) (i.e., vertical and/or horizontal directions), and also introduces significant coupling inertia effects (i.e., products of inertia) during a typical swing motion.

Figure 4C:
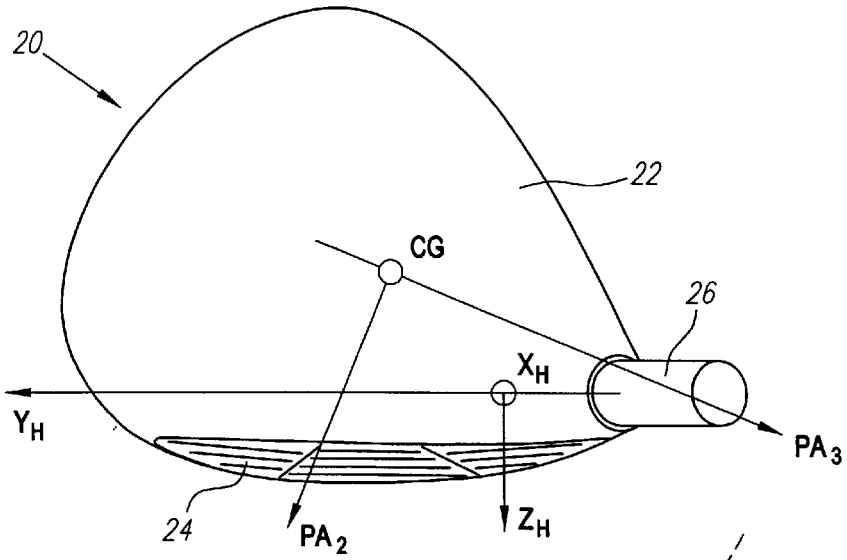
FIG. 4C (PRIOR ART)
FIG. 4(*a*) is a toe-side view of the conventional metal wood golf club head showing a nominal center of gravity (CG) location and the principal inertia axes of the golf club head.
Figure 4B:
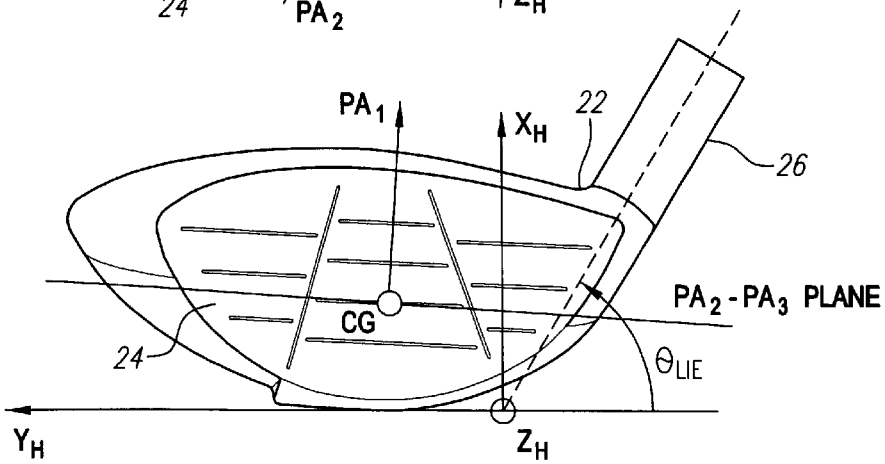
FIG. 4B (PRIOR ART)
Figure 4A:
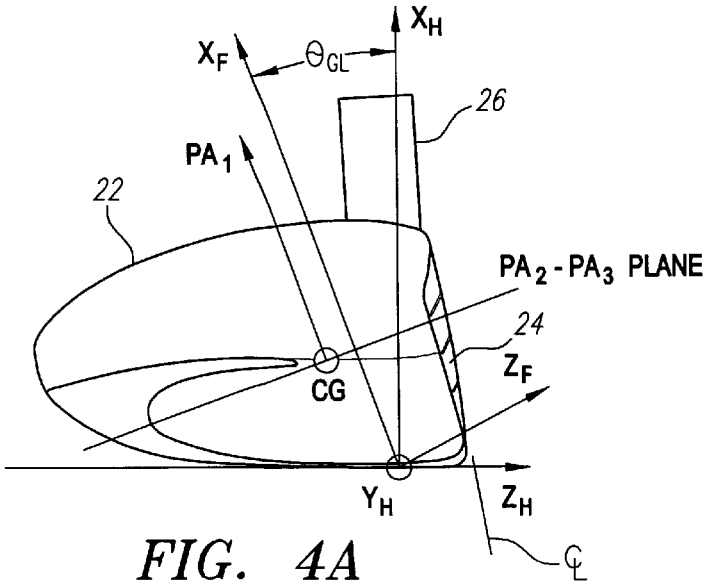
FIG. 4A (PRIOR ART)

Similarly, as illustrated in FIGS. 4(*a*)–4(*c*), it has been experimentally observed in test cases of commercially available metal wood club heads 20 that one of the principal axes of inertia $PA_1$, which corresponds to the direction of maximum inertia, lies in a near vertical plane ($PA_1$–$PA_2$) and has a slightly rearward tilt associated with the geometric loft angle $\theta_{GL}$ of the club heads 20. The other two principal axes $PA_2$ and $PA_3$ have been found to lie in a near horizontal plane, where one of the axes $PA_3$ (corresponding to the minimum inertia direction) extends through the center of gravity (CG) of the club head 20 in the direction of the hosel region 26 of the club head 20, and the other axis $PA_2$ (corresponding to the intermediate inertia direction) is perpendicular thereto. The near alignment of the principal inertia axis $PA_3$ with the hosel region 26 results from the presence of internal and/or external structural mass located within that region. Finally, as was the case with regard to conventional iron and wedge type golf club heads, the principal axes of inertia $PA_1$, $PA_2$, and $PA_3$ of conventional metal wood club heads 20 are significantly rotated with respect to the global club head axes ($X_H$, $Y_H$, $Z_H$), thus introducing significant coupling inertia effects (i.e., products of inertia) during a typical swing motion.

Figure 5C:
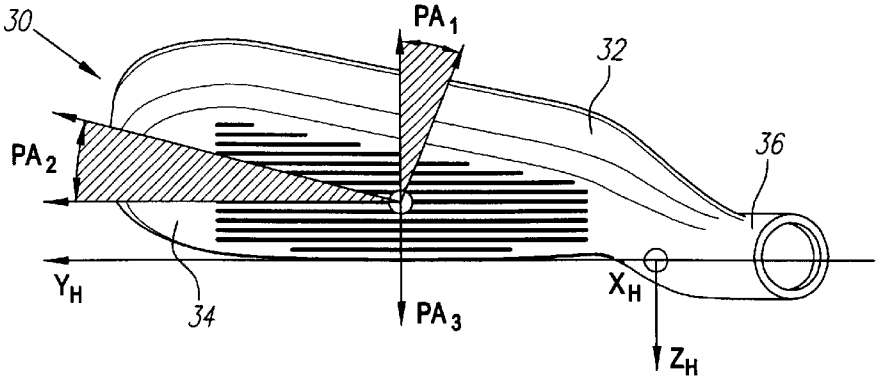
FIG. 5(*a*) is a toe-side view of a wedge or iron type golf club head in accordance with the present invention showing a nominal center of gravity (CG) location and preferred principal inertia axes of the golf club head.
Figure 5B:
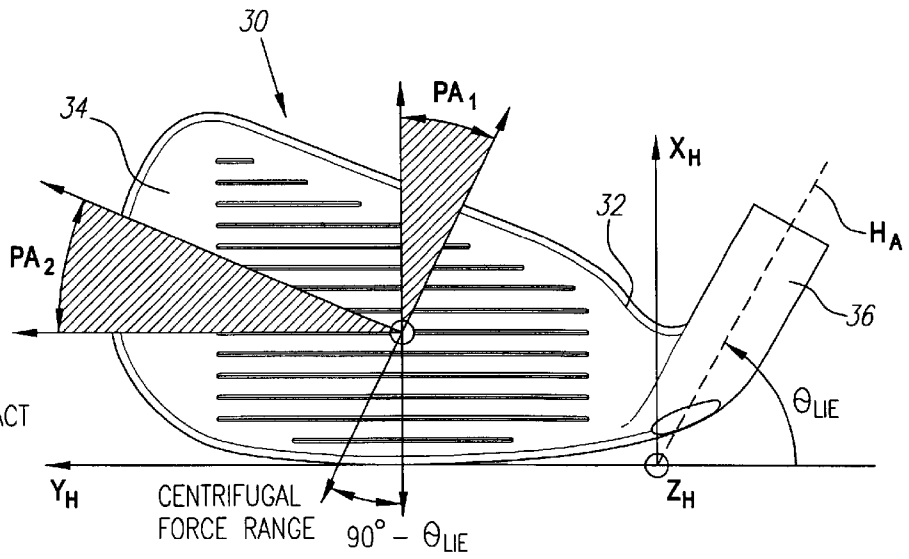
Figure 5A:
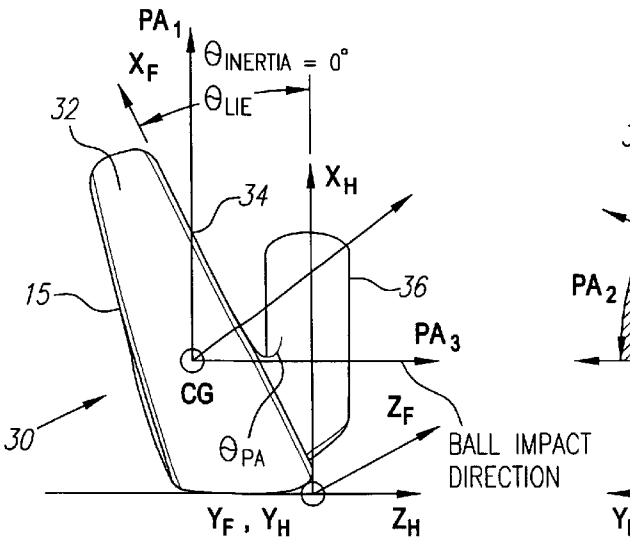
Figure 6C:
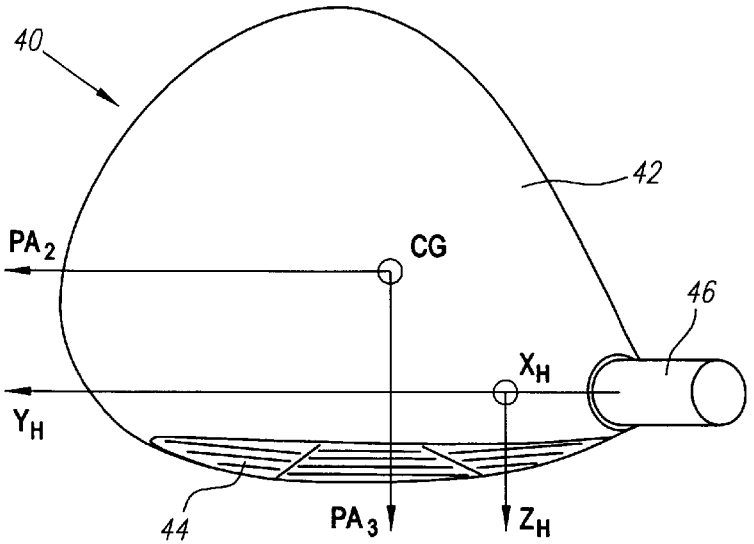
FIG. 6(*a*) is a toe-side view of a metal wood golf club head in accordance with the present invention showing a nominal center of gravity (CG) location and preferred principal inertia axes of the golf club head.
Figure 6B:
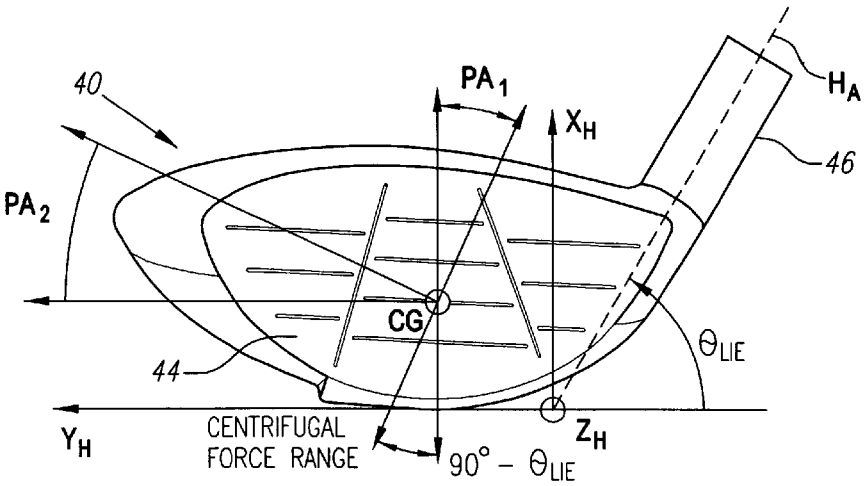
Figure 6A:
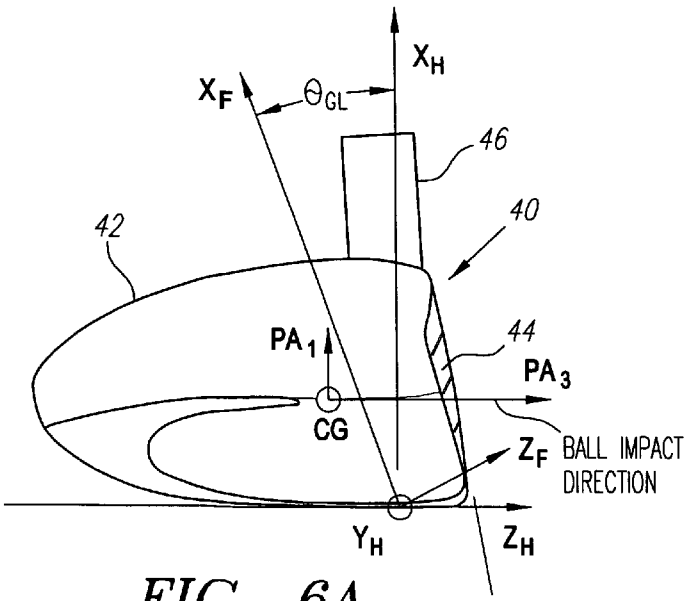

Turning now to FIGS. 5(*a*)–5(*c*) and 6(*a*)–6(*c*), the principal axes of inertia $PA_1$, $PA_2$, and $PA_3$ of golf club heads 30 and 40 designed in accordance with the present invention are preferably aligned with the directions of the primary forces (ball impact, aerodynamic drag, inertia and centrifugal) that act upon the club heads 30 and 40 during a typical swing motion or, alternatively, with the global axes ($X_H$, $Y_H$, $Z_H$) of the club heads 30 and 40. Thus, in accordance with the present invention one of the principal axes $PA_3$ will preferably point in the direction of the inertia force or a force that is exerted upon the club head 30 or 40 when a ball impacts upon the face 34 or 44 of the club head 30 or 40 during a typical swing. This direction is denoted as direction $Z_H$ within the drawings (i.e., the principal axis $PA_3$ lies in a horizontal plane and is parallel to the global coordinate axis $Z_H$). Another principal axis of inertia $PA_1$ is preferably perpendicular to the principal axis $PA_3$ and points in the direction of the centrifugal force that is exerted upon the club head 30 or 40 during a typical swing motion. As the direction of the centrifugal force that acts upon the club head 30 or 40 during a swing may vary depending, inter alia, upon shaft flex and toe-down effects, the orientation of the principal axis $PA_1$ will generally range from vertical to a direction parallel to the hosel axis $H_A$ of the club head 30 or 40. Finally, the remaining principal axis $PA_2$ will be oriented in an orthogonal fashion with the other two principal axes $PA_1$ and $PA_3$.

Should it be found for a particular golf club head design that it is not possible to orient one of the principal axes of inertia (for example, principal axis $PA_3$) with the direction of the ball impact force (i.e., in the horizontal plane), one of the principal axes may be oriented such that it forms an acute angle $\theta_{PA}$ with the club face plane ($X_F$–$Y_F$). The acute angle $\theta_{PA}$ is referred to herein as the principal face angle. An exemplary set of principal face angles for a typical set of golf club heads numbered 1 through SW (i.e., 1 through sand wedge) is set forth, along with exemplary geometric loft angles, in the table below. Those skilled in the art will appreciate, of course, that the principal face angles listed in the chart below are exemplary, and that those angles may be adjusted depending upon the design goals for a given golf club or set of golf clubs. For example, for some applications it may be desirable to limit the maximum principal face angle $\theta_{PA}$ to 75° or 80°.

TABLE 1

Geometric Loft ($\theta_{GL}$) and Principal Face ($\theta_{PA}$) Angles for a Set of Golf Club Heads in Accordance with One Form of the Present Invention

| | #1 | #2 | #3 | #4 | #5 | #6 | #7 | #8 | #9 | PW | SW |
|---|---|---|---|---|---|---|---|---|---|---|---|
| $\theta_{GL}$ | 17° | 20° | 23° | 26° | 29° | 33° | 37° | 41° | 46° | 51° | 56° |
| $\theta_{PA}$ | 73–90° | 70–90° | 67–90° | 64–90° | 61–90° | 57–90° | 53–90° | 49–90° | 44–90° | 39–90° | 34–90° |

As for the magnitudes of the moments of inertia about the principal axes $PA_1$, $PA_2$, and $PA_3$, it will be appreciated that, by varying the magnitudes of inertia about the preferred principal axes $PA_1$, $PA_2$, and $PA_3$, it is possible to directly control the dynamic behavior of a golf club head 30 or 40. For example, the effective sweet spot region of a golf club head 30 or 40 may be increased by increasing the moment of inertia about the principal axis $PA_1$; the resistance to changes in the dynamic loft of the golf club head 30 or 40 upon ball impact may be increased by increasing the moment of inertia about the principal axis $PA_2$; and an overall club toe-down effect may be altered by changing the moment of inertia about principal axis $PA_3$.

In view of this, it is presently preferred that for iron and wedge type golf club heads 30 the intermediate and maximum magnitude moments of inertia will be associated with the principal axes $PA_1$ and $PA_3$, and the minimum magnitude moment of inertia will be associated with principal axis $PA_2$. The reason for this is that both the center of gravity CG of the golf club head 30 and the ball impact point (not shown) are generally located low in relation to the club face 34. Thus, dynamic ball impact related moments or torques that could induce dynamic club head loft changes during a swing are negligible.

As for low-loft metal wood club heads 40, it is presently preferred that the maximum moment of inertia be associated with the principal axis $PA_1$ to provide maximum resistance to club face opening or closing as a result of toe/heel mishits, and that the intermediate and minimum moments of inertia be associated with principal axes $PA_2$ and $PA_3$. The association of the intermediate and minimum moments of inertia with the principal axes $PA_2$ and $PA_3$ may vary with the design goals for a given golf club. For example, a large intermediate inertia may be preferred in the direction of principal axis $PA_2$ where it is desired to minimize head loft changes resulting from tee shots hit high or low on the face of the club head or, alternatively, a large intermediate moment of inertia may be preferred in the direction of principal axis $PA_3$ where it is desired to resist club head toe-down effects.

Figure 7C:
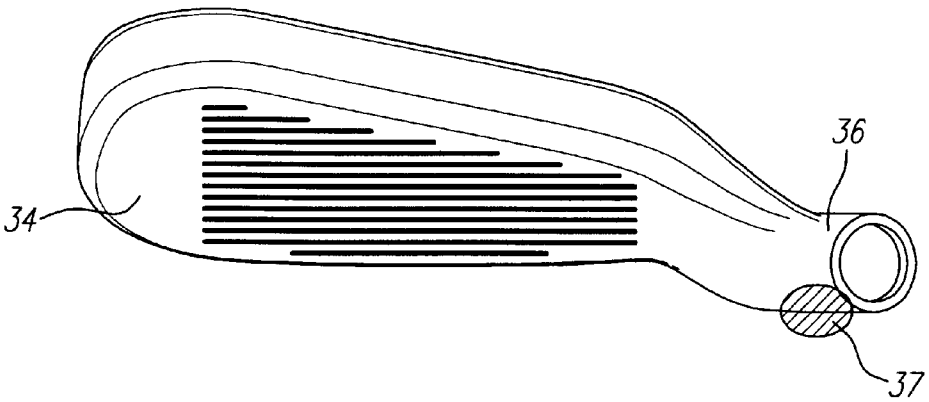
FIG. 7(*a*) is a toe-side view of an wedge or iron type golf club head showing regions with added mass concentrations in accordance with the present invention.
Figure 7B:
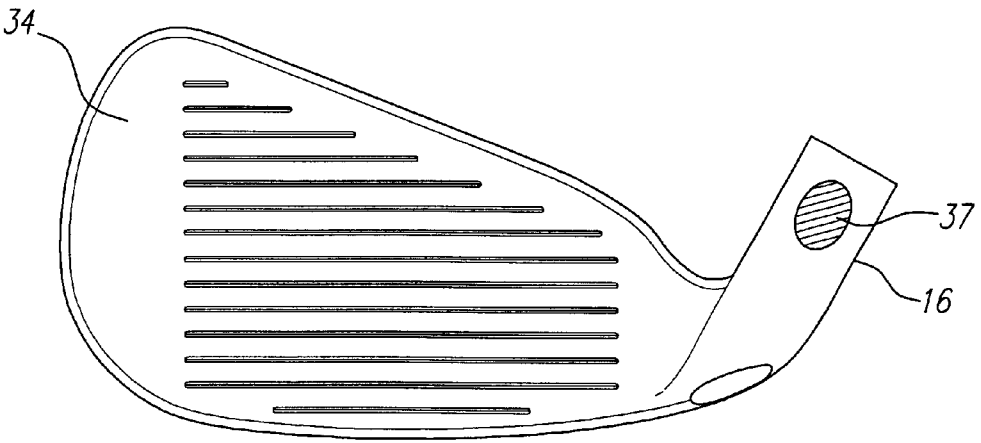
Figure 7A:
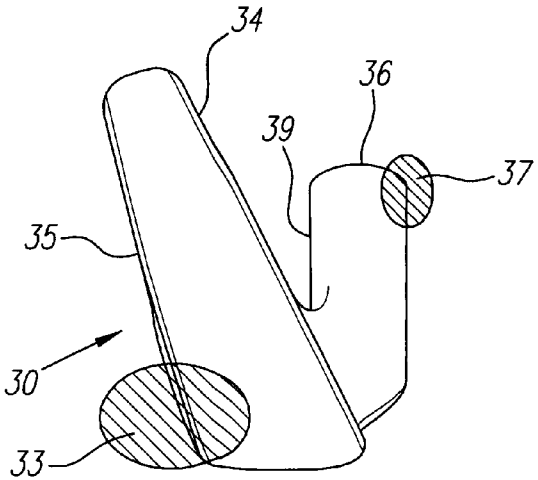
Figure 8C:
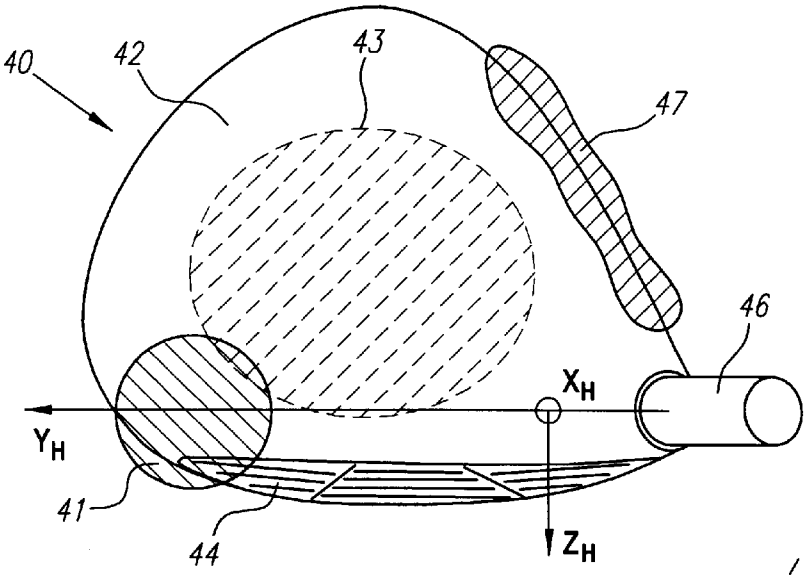
FIG. 8(*a*) is a toe-side view of a metal wood golf club head showing regions with added mass concentrations in accordance with the present invention.
Figure 8B:
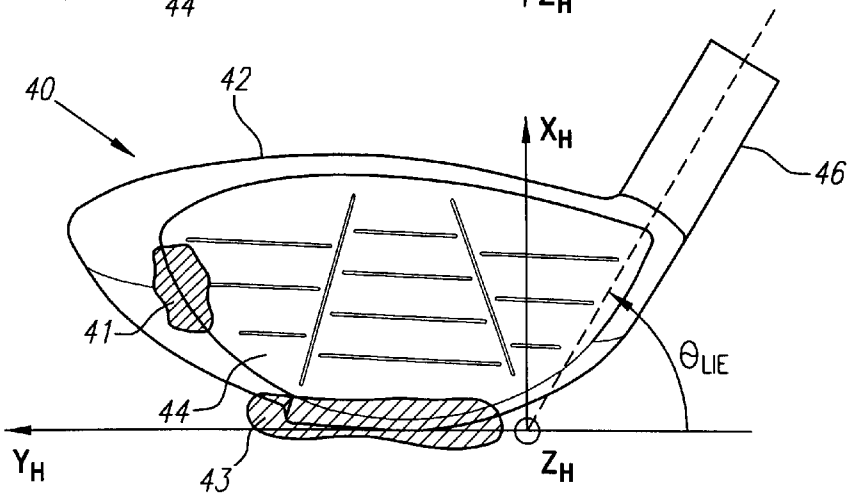
Figure 8A:
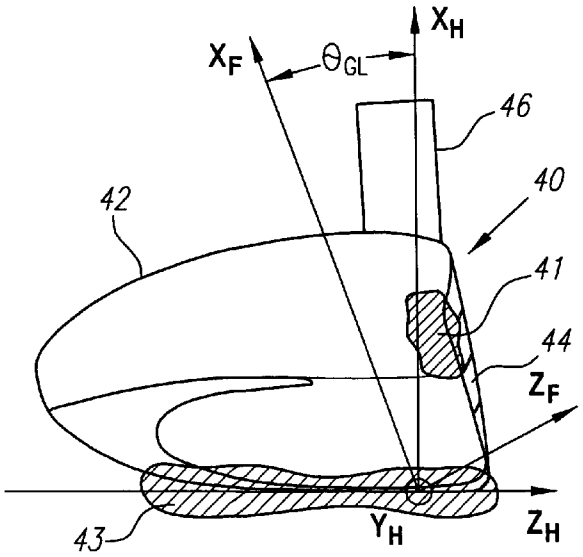

Turning now to FIGS. 7(*a*)–7(*c*) and 8(*a*)–8(*c*), where it is desired to achieve a set of principal axes of inertia $PA_1$, $PA_2$, and $PA_3$, as described above and illustrated in FIGS. 5(*a*)–5(*c*) and 6(*a*)–6(*c*), it is presently preferred to distribute the mass within a golf club head 30 or 40 in the following manner.

For iron or wedge type golf clubs 30, it is presently preferred to minimize the amount of mass located on the upper backside 35 of the face 34 and backside 39 of the hosel 36, and to concentrate the mass of the golf club head 30 as low and as far rearward as possible from the club face 34. The area of preferred mass concentration is identified as 33 in FIG. 7(*a*). Such an allocation of mass is described in some detail in application Ser. No. 08/792,957, in the names of Richard C. Helmstetter, Thomas R. Hilton, Donald A. Bistline, and Victor S. Dennis, which application is entitled "Inertially Tailored Golf Club Head," is being filed simultaneously herewith, and is assigned to the assignee hereof. The above-referenced application is hereby incorporated by reference, as if fully set forth herein. Alternatively, or in addition, it may be desirable to add mass to the upper forward region 37 of the hosel 36. This will raise slightly the center of gravity CG of the golf club head 30, better orient the inertia axes $PA_1$, $PA_2$ and $PA_3$ of the golf club head 30, increase the inertia about a vertical axis $X_H$ (improve the sweet spot effect), and lower the inertia about the hosel (or shaft) axis $H_A$, thus allowing the golf club head 30 to be more easily squared with a ball at the moment of ball impact.

For metal wood club heads 40, it is presently preferred to minimize the amount of mass located within the hosel region 46, to concentrate the mass of the golf club head 40 toward the toe/sole interface 41 near the club face 44, to concentrate the mass of the golf club head 40 in the heel/sole region 47 of the body 42 of the club head 40, and/or to concentrate the mass of the golf club head 40 in the sole region 43.

To concentrate the mass of a golf club head in the manners described above, it is presently preferred to use materials having substantially different densities to form distinct regions within the golf club head. For example, when designing golf club heads 30 or 40 in accordance with the present invention, it is presently preferred to form a substantial portion of the golf club head 30 from, for example, titanium (or some other lightweight material) and to form the regions of concentrated mass 33, 37, 41, 43 and 47 (shown in FIGS. 7(*a*)–(*c*) and 8(*a*)–(*c*)) from a different substantially heavier material, for example, tungsten.

Finally, in view of the foregoing, it will be understood that, by defining a preferred set of principal axes of inertia $PA_1$, $PA_2$, and $PA_3$ for each golf club head used within a set of golf clubs (not shown), it is possible to provide not only inertially tailored individual golf clubs and golf club heads, but also an inertially tailored set of golf clubs. For example, it may be desired in accordance with the present invention to define a preferred set of principal axes of inertia $PA_1$, $PA_2$, and $PA_3$ that are consistent within a global frame of reference and are applicable to each of the golf club heads used within a set. Alternatively, it may be desired to vary the directions of the principal axes of inertia $PA_1$, $PA_2$, and $PA_3$ and/or the moments about those axes in a predetermined progression to achieve a unique feel within a set of golf clubs.

While the invention is susceptible to various modifications and alternative forms, specific examples thereof have been shown in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A method of designing a golf club head, said method comprising:

selecting a location for a center of gravity of the golf club head, selecting magnitudes and directions for a set of principal moments of inertia of the golf club head, said principal moments of inertia defining a maximum moment, a minimum moment and an intermediate moment of inertia and being oriented along orthogonal axes intersecting at said location of said center of gravity;

orienting a principal axis associated with the maximum moment of inertia such that an inertia loft angle of the golf club head is less than the geometric loft angle of the golf club head; and distributing mass within said golf club head such that the center of gravity of the golf club head is located at said selected location, and such that the principal moments of inertia of the golf club head have said selected magnitudes and directions.

2. The method of claim 1, wherein said step of distributing mass within the golf club head includes the steps of:

using a first material having a first density to define a first portion of the golf club head, and using a second material having a second density greater than said first density to define at least one additional portion of the golf club head.

3. A method of designing a golf club head, said method comprising:

selecting a location for a center of gravity of the golf club head;

selecting magnitudes and directions for a set of principal moments of inertia of the golf club head, said principal moments of inertia defining a maximum moment, a minimum moment and an intermediate moment of inertia and being oriented along orthogonal axes intersecting at said location of said center of gravity;

orienting a first principal axis in a horizontal plane and pointing in a direction perpendicular to a face of said golf club head;

orienting a second principal axis in a vertical plane and pointing in a direction ranging from vertical to a direction parallel to a shaft lie axis of said golf club head;

orienting a third principal axis in a direction orthogonal to said first and second principal axes; and distributing mass within said golf club head such that the center of gravity of the golf club head is located at said selected location, and such that the principal moments of inertia of the golf club head have said selected magnitudes and directions.

4. The method of claim 3, wherein within said orienting steps said first principal axis is associated with said maximum moment of inertia, said second principal axis is associated with said minimum moment of inertia, and said third principal axis is associated with said intermediate moment of inertia.

5. The method of claim 3, wherein said orienting steps said first principal axis is associated with said minimum moment of inertia, said second principal axis is associated with said maximum moment of inertia, and said third principal axis is associated with said intermediate moment of inertia.

6. The method of claim 3, wherein within said orienting steps said first principal axis is associated with said intermediate moment of inertia, said second principal axis is associated with said minimum moment of inertia, and said third principal axis is associated with said maximum moment of inertia.

7. The method of claim 3, wherein within said orienting steps said first principal axis is associated with said maximum moment of inertia, said second principal axis is associated with said intermediate moment of inertia, and said third principal axis is associated with said minimum moment of inertia.

8. The method of claim 3, wherein within said orienting steps said first principal axis is associated with said intermediate moment of inertia, said second principal axis is associated with said maximum moment of inertia, and said third principal axis is associated with said minimum moment of inertia.

9. The method of claim 3, wherein within said orienting steps said first principal axis is associated with said minimum moment of inertia, said second principal axis is associated with said intermediate moment of inertia, and said third principal axis is associated with said maximum moment of inertia.

10. A method of designing a golf club head, said method comprising the steps of:

determining a preferred location for a center of gravity of the golf club head, determining preferred magnitudes and directions for a plurality of principal moments of inertia of the golf club head, said plurality of principal moments of inertia being selected from a maximum moment, a minimum moment and an intermediate moment of inertia and being oriented along orthogonal axes intersecting at said location of said center of gravity;

orienting a principal axis associated with the maximum moment of inertia such that an inertia loft angle of the wolf club head is less than the geometric loft angle of the golf club head; and distributing mass within the golf club head such that the center of gravity of the golf club head is located at said preferred location, and such that the plurality of principal moments of inertia of the golf club head have said preferred magnitudes and directions.

11. A method of designing a golf club head, said method comprising:

determining a preferred location for center of gravity of the golf head;

determining preferred magnitudes and directions for a plurality of principal moments of inertia of the golf club head, said plurality of principal moments of inertia being selected from a maximum moment, a minimum moment and an intermediate moment of inertia and being oriented along orthogonal axes intersecting at said location of said center of gravity;

orienting a first principal axis in a horizontal plane and pointing in a direction perpendicular to a face of said golf club head;

orienting a second principal axis in a vertical plane and pointing in a direction ranging from vertical to a direction parallel to a shaft lie axis of said golf club head;

orienting a third principal axis in a direction orthogonal to said first and second principal axes; and distributing mass within said golf club head such that the center of gravity of the golf head is located at said preferred location, and such that the plurality of principal moments of inertia of the golf club head have said preferred magnitudes and directions.

12. A method of designing a golf club head, said method comprising the steps of:

determining a preferred location for a center of gravity of the golf club head;

determining preferred directions for a plurality of principal moments of inertia of the golf club head, said plurality of principal moments of inertia being selected from a maximum moment, a minimum moment and an intermediate moment of inertia and being oriented along orthogonal axes intersecting at said location of said center of gravity;

orienting a first principal axis in a horizontal plane and pointing in a direction perpendicular to a face of said golf club head;

orienting a second principal axis in a vertical plane and pointing in a direction ranging from vertical to a direction parallel to a shaft lie axis of said golf club head;

orienting a third principal axis in a direction orthogonal to said first and second principal axes; and distributing mass within the golf club head such that the center of gravity of the golf club head is located at said preferred location, and such that the plurality of principal moments of inertia of the golf club head have said preferred directions.

13. A method of designing a golf club head, said method comprising the steps of:

determining a preferred location for a center of gravity of the golf club head;

determining a preferred direction for at least one principal moment of inertia of the golf club head, said at least one principal moment of inertia being selected from a maximum moment, a minimum moment and an intermediate moment of inertia and being oriented along an axis intersecting said location of said center of gravity;

orienting a principal axis associated with the maximum moment of inertia such that an inertia loft angle of the golf club head is less than the geometric loft angle of the golf club head; and distributing mass within the golf club head such that the center of gravity of the golf club head is located at said preferred location, and such that the at least one principal moment of inertia of the golf club head has said preferred direction.

14. A method of designing a golf club head, said method comprising:

determining a preferred location for a center of gravity of the golf club head;

determining a preferred direction for at least one principal moment of inertia of the golf club head, said at least one principal moment of inertia being selected from a maximum moment, a minimum moment and an intermediate moment of inertia and being oriented along an axis intersecting said location of said center of gravity;

orienting a first principal axis in a horizontal plane and pointing in a direction perpendicular to a face of said golf club head;

orienting a second principal axis in a vertical plane and pointing in a direction ranging from vertical to a direction parallel to a shaft lie axis of said golf club head;

orienting a third principal axis in a direction orthogonal to said first and second principal axes; and distributing mass within the golf club head such that the center of gravity of the golf club head is located at said preferred location, and such that the at least one principal moment of inertia of the golf club head has said preferred direction.

15. A method of improving a dynamic behavior characteristic of an iron or wedge type golf head, said method comprising the steps of:

reducing a concentration of mass within said golf club head in an upper backside region of a body section of said golf club head, and increasing a concentration of mass within said golf club head in a lower rearward section of said body of said golf club head, whereby a principal axis of said golf club head is oriented such that it forms an acute principal face angle with a plane of a face of said golf club head, said principal axis of said golf club head corresponding to a moment of inertia selected from a maximum moment, a minimum moment and an intermediate moment of inertia and passing through a location of a center of gravity of said golf club head.

16. The method of claim 15, wherein by virtue of said reducing and increasing steps said principal axis of said golf club head lies in a horizontal plane.

17. The method of claim 16, further comprising the steps of:

reducing a concentration of mass in an upper backside hosel region of said golf club head, and increasing a concentration of mass in an upper front hosel region of said golf club head.

18. A method of designing a set of golf clubs, said method comprising the steps of:

defining a preferred swing weight, mass, loft angle and lie angle for a plurality of golf club heads used within said set;

defining a preferred direction for at least one principal axis of inertia of each of said golf club heads, said at least one principal axis of inertia of each said golf club head intersecting a center of gravity of a respective golf club head and corresponding to a principal moment of inertia selected from a group of a maximum moment, a minimum moment and an intermediate moment of inertia of said golf club head, wherein the preferred direction for said at least one principal axis of inertia of each said golf club head within said set vary in accordance with a predetermined progression; and distributing mass within each of said golf club heads such that the principal axis of inertia for each golf club head has the direction preferred for that golf club head.

19. The method of claim 18, wherein by virtue of said step of defining a preferred direction for at least one principal axis of inertia of each of said golf club heads a result is achieved that each of said golf club heads has a principal axis of inertia that points in a common direction.

* * * * *